United States Patent [19]

Okutsu et al.

[11] 4,221,857

[45] Sep. 9, 1980

[54] PROCESS FOR PRODUCING A HIGH CONTRAST PHOTOGRAPHIC IMAGE

[75] Inventors: Eiichi Okutsu; Yoshitaka Akimura; Shunji Takada; Hiroyuki Mifune, all of Minami-ashigara, Japan

[73] Assignee: Fuji Photo Film Co., Ltd., Minami-ashigara, Japan

[21] Appl. No.: 934,785

[22] Filed: Aug. 18, 1978

[30] Foreign Application Priority Data

Aug. 30, 1977 [JP] Japan ..... 52/104012

[51] Int. Cl.[2] ..... G03C 5/30; G03C 1/06

[52] U.S. Cl. ..... 430/264; 430/266; 430/444; 430/448; 430/602; 430/599; 430/567

[58] Field of Search ..... 96/95, 107, 109, 66

[56] References Cited

U.S. PATENT DOCUMENTS

| | | | |
|---|---|---|---|
| 2,495,000 | 1/1950 | Hanford | 96/22 |
| 2,498,418 | 2/1950 | Hanford | 96/22 |
| 2,892,715 | 6/1959 | Hunsberger | 96/66.5 |
| 3,340,058 | 9/1967 | von König | 96/95 |
| 3,730,727 | 5/1973 | Olivares et al. | 96/95 |
| 3,782,949 | 1/1974 | Olivares et al. | 96/76 R |
| 4,030,925 | 6/1977 | Leone et al. | 96/107 |

*Primary Examiner*—Mary F. Downey

*Attorney, Agent, or Firm*—Sughrue, Rothwell, Mion, Zinn and Macpeak

[57] ABSTRACT

A process for producing a high contrast photographic image comprising developing an image-wise exposed silver halide photographic light-sensitive material comprising a support having thereon at least one silver halide emulsion layer with a developer containing (a) free sulfite ion in a concentration of at least 0.18 mol/l and (b) as substantially the only developing agent a dihydroxybenzene in the presence of (i) at least one compound represented by the following general formula (I);

$$R^1NHNHCOR^2 \quad (I)$$

wherein $R^1$ represents an aryl group; $R^2$ represents a hydrogen atom, a phenyl group or an unsubstituted alkyl group having 1 to 3 carbon atoms and (ii) at least one polyalkylene oxide having a molecular weight of at least 600 or a derivative thereof.

12 Claims, No Drawings

PROCESS FOR PRODUCING A HIGH CONTRAST PHOTOGRAPHIC IMAGE

BACKGROUND OF THE INVENTION

1. Field of the Invention

This invention relates to a process for developing a silver halide photographic emulsion, which provides an ultra high contrast negative image, excellent dot quality and excellent tonal gradiation.

2. Description of the Prior Art

A method of obtaining photographic characteristics of a high contrast negative image by adding a hydrazine compound to a silver halide photographic emulsion is described in U.S. Pat. No. 2,419,975. U.S. Pat. No. 2,419,975 discloses that extremely high contrast photographic characteristics, such as a gamma ($\gamma$) of more than 10, can be obtained by adding a hydrazine compound to a silver chlorobromide emulsion and developing the emulsion with a developer having a pH as high as 12.8. However, strongly alkaline developers having a pH near 13 are so unstable that they tend to be oxidized by air and, therefore, cannot be used or stored for long periods of time. Moreover, development at such a high pH tends to cause fog.

However, it is known that the high contrast photographic characteristics of a gamma of as high as more than 10 as described in U.S. Pat. No. 2,419,975 are still insufficient to obtain satisfactory dot quality and tonal gradation for platemaking using, for example, a contact screen, and that infectious development characteristics as are obtained by using a lithographc developer containing a sulfite at a low concentration are necessary for attaining these objects.

U.S. Pat. No. 3,386,831 describes a process for stabilizing an emulsion by adding a mono-phenylhydrazide of an aliphatic carboxylic acid to an essentially surface-sensitive photographic silver halide emulsion. The object and effect of U.S. Pat. No. 3,386,831 is different from the objects and effect of the present invention.

On the other hand, Japanese Patent Application (OPI) No. 19836/72 (The term "OPI" as used herein refers to a "published unexamined Japanese patent application") corresponding to U.S. Pat. No. 3,972,719 describes a process for obtaining photographic characteristics suitable for the reproduction of dot images or lines using a stable developer. Japanese Patent Application (OPI) 19836/72 contains the description that images with good dot quality can be obtained by developing a silver halide light-sensitive material with a developer containing (1) a p-dihydroxybenzene derivative, (2) at least 5 g/l sulfite ion and (3) a nitroindazole or nitrobenzimidazole compound. However, this process is still unsatisfactory from a practical standpoint for producing a photographic plate for plate-making containing dot images, since the developer results in inferior dot quality as compared with a conventional lithographic type developer although stability of the developer is improved to some extent. In addition, this process has the defect that the dot quality seriously deteriorates as the sulfite ion concentration is increased for stabilizing the developer.

Also, it is known that high contrast silver halide light-sensitive materials are generally so sensitive to the products formed by development that localized developing effects occur. In particular, when such light-sensitive materials are developed using an automatic developing machine, the phenomenon that the density at the area adjacent the area where development occurs only slightly becomes high due to excess development whereas the density at the area adjacent the area where development sufficiently occurs becomes low due to inhibition of development. This phenomenon is called "drag streaks" and, particularly in the case of conducting development using an automatic developing machine, drag streaks tend to occur since films are conveyed in a definite direction.

As is described above, obtaining excellent dot quality and tonal gradation with ultra high contrast photographic characteristics which is useful in the reproduction of lines has been eagerly desired using a stable developer. In addition, development of a process for reducing drag streaks has been strongly desired.

SUMMARY OF THE INVENTION

An object of the present invention is to provide a process for developing a silver halide photographic light-sensitive material to thereby obtain extremely high contrast negative images having a gamma of more than 10 using a stable developer.

Another object of the present invention is to provide a process for developing a silver halide photographic light-sensitive material to thereby obtain good dot quality using a stable developer.

A further object of the present invention is to provide a process for developing a silver halide photographic light-sensitive material to thereby obtain good tonal gradation using a stable developer.

Still a further object of the present invention is to provide a process for developing with less drag streaks being formed.

These and other objects of the present invention will become apparent from the following description thereof.

The above-described and other objects of the present invention are attained in one embodiment of the process of this invention for producing a high contrast photographic image which comprises developing an image-wise exposed silver halide photographic light-sensitive material comprising a support having thereon at least one silver halide emulsion layer with a developer containing (a) free sulfite ion in a concentration of at least about 0.18 mol/l and (b), substantially as the only developing agent, a dihydroxybenzene in the presence of (i) at least one compound represented by the following general formula (I);

$$R^1NHNHCOR^2 \qquad (I)$$

wherein $R^1$ represents an aryl group; $R^2$ represents a hydrogen atom, a phenyl group or an unsubstituted alkyl group having 1 to 3 carbon atoms, and (ii) at least one polyalkylene oxide having a molecular weight of at least about 600 or a derivative thereof.

In another embodiment, this invention provides a process for producing a high contrast photographic image which comprises developing an image-wise exposed silver halide photographic light-sensitive material comprising a support having thereon at least one silver halide emulsion layer with a developer containing (a) free sulfite ion in a concentration of at least about 0.18 mol/l and (b), substantially as the only developing agent, a dihydroxybenzene in the presence of (i) at least one compound represented by the general formula (I);

$$R^1NHNHCOR^2 \qquad (I)$$

wherein $R^1$ represents an aryl group, $R^2$ represents a hydrogen atom, a phenyl group or an unsubstituted alkyl group having 1 to 3 carbon atoms, and (II) at least one polyalkylene oxide having a molecular weight of at least about 600 or a derivative thereof, and (iii) at least one compound represented by the following general formula (II):

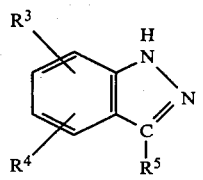

(II)

wherein $R^3$ represents a hydrogen atom or a nitro group, and $R^4$ and $R^5$, which may be the same or different, each represents a hydrogen atom or an alkyl group having 1 to 4 carbon atoms which may be unsubstituted or substituted with an unsubstituted alkyl group being preferred.

DETAILED DESCRIPTION OF THE INVENTION

According to the present invention, it is possible to obtain the necessary infectious development characteristics for obtaining sufficient dot quality and tonal gradation for plate-making, even in the case of using a developer having a high free sulfite ion concentration, by using (i) a hydrazine compound represented by the general formula (I) above and (ii) a polyalkylene oxide compound having a molecular weight of 600 or more or a derivative thereof in combination. In addition, the use of (iii) a compound represented by the general formula (II) above together with the above-described combination of the hydrazine compound (i) and the polyalkylene oxide (ii) enables a higher density of dots without fringe to be obtained than that obtained using the conventional combination of a lithographic light-sensitive material and a lithographic developer.

Furthermore, the developing process of the present invention does not cause drag streaks, which are unavoidable in conventional lithographic development processings, to form.

The silver halide in the silver halide photographic light sensitive material which is used in the present invention can be silver chloride, silver chlorobromide, silver bromide, silver iodobromide, or silver iodochlorobromide. The average grain size of the silver halide is preferably less than about 0.7$\mu$, and more preferably less than about 0.4$\mu$. The silver halide emulsion of the present invention preferably contains a binder in an amount of not more than about 250 g per mol of silver halide.

The silver halide emulsion layer or a hydrophilic colloid layer thereto may contain at least one compound represented by the following general formula (I);

$$R^1NHNHCOR^2 \quad \text{(I)}$$

wherein $R^1$ represents a monocyclic or bicyclic aryl group and $R^2$ represents a hydrogen atom, a phenyl group or an unsubstituted alkyl group having 1 to 3 carbon atoms.

The compounds represented by the general formula (I) are preferably present in the light sensitive material, but they may be present in the developer.

The aryl group represented by $R^1$ in the general formula (I) may be unsubstituted or substituted with one or more substituents which are not electron-attracting, such as alkyl groups having 1 to 20 carbon atoms (which may be straight or branched chained, e.g., methyl, ethyl, propyl, isopropyl, n-butyl, isobutyl, n-octyl, n-hexyl, tert-octyl, n-decyl, n-dodecyl, etc.), aralkyl groups having 1 to 3 carbon atoms in the alkyl moiety thereof (e.g., benzyl, phenethyl, etc.), alkoxy groups having 1 to 20 carbon atoms (in which the alkyl moiety may be straight or branched chain, e.g., methoxy, ethoxy, 2-methylpropoxy, etc.), amino groups which are mono- or disubstituted with alkyl groups having 1 to 20 carbon atoms (in which the alkyl groups may be straight or branched chain), aliphatic acylamino groups having 2 to 21 carbon atoms in the acyl moiety or aromatic acylamino groups (e.g., acetylamino, octynylamino, benzoylamino, dimethylamino, etc.), etc.

$R^2$ in the general formula (I) represents a hydrogen atom, an unsubstituted alkyl group having 1 to 3 carbon atoms (which may be straight or branched chained, e.g., methyl, ethyl, n-propyl and isopropyl) or a phenyl group. The phenyl group may be unsubstituted or substituted with one or more substituents which preferably are electron-attracting groups, such as a halogen atom (e.g., chlorine or bromine, etc.), a cyano group, a trifluoromethyl group, a carboxyl group or a sulfo group, etc.

Specific examples of suitable substituents represented by $R^1$ are a phenyl group, an $\alpha$-naphthyl group, a $\beta$-naphthyl group, a p-tolyl group, an m-tolyl group, an o-tolyl group, a p-methoxyphenyl group, an m-methoxyphenyl group, a p-dimethylaminophenyl group, a p-diethylaminophenyl group, a p-(acetylamino)phenyl group, a p-(capryloylamino)phenyl group, a p-(benzoylamino)phenyl group and a p-benzylphenyl group.

Specific examples of suitable substituents represented by $R^2$, other than a hydrogen atom, are a methyl group, an ethyl group, an n-propyl group, an isopropyl group, a phenyl group, a 4-chlorophenyl group, a 4-bromophenyl group, a 3-chlorophenyl group, a 4-cyanophenyl group, a 4-carboxyphenyl group, a 4-sulfophenyl group, a 3,5-dichlorophenyl group and a 2,5-dichlorophenyl group.

The substituent represented by $R^1$ is preferably a monocyclic aryl group, and an unsubstituted phenyl group and a tolyl group are particularly preferred as $R^1$.

The substituent represented by $R^2$ is preferably a hydrogen atom, a methyl group or a phenyl group which may be substituted. A hydrogen atom is particularly preferred for $R^2$.

Of the compounds represented by the above-described general formula (I), preferred compounds are represented by the following general formula (Ia):

$$R^1NHNHCOR^{12} \quad \text{(Ia)}$$

In the above formula, $R^1$ has the same meaning as in the above-described general formula (I). $R^{12}$ represents a hydrogen atom, a methyl group, an unsubstituted phenyl group or a phenyl group substituted with one or more electron attracting groups (e.g., as described above).

Of the compounds represented by the general formula (Ia) above, compounds represented by the following general formula (Ib) are preferred.

$R^{11}NHNHCHO$ (Ib)

In the above formula (Ib), $R^{11}$ represents an unsubstituted phenyl group, a p-tolyl group or a m-tolyl group.

Specific examples of the compounds represented by the general formula (I) are given below, but this invention is not to be construed as being limited thereto.

(I-1)

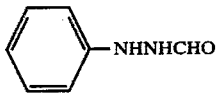

(I-2)

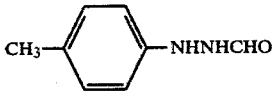

(I-3)

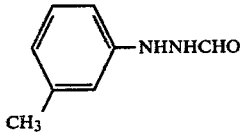

(I-4)

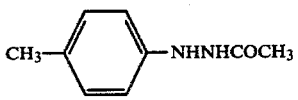

(I-5)

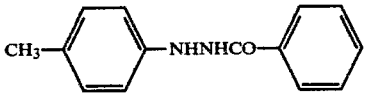

(I-6)

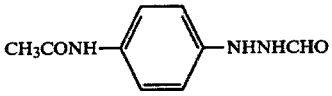

(I-7)

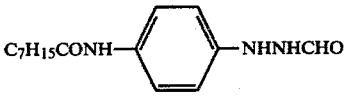

(I-8)

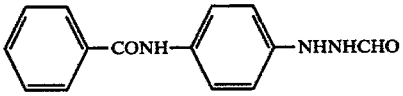

(I-9)

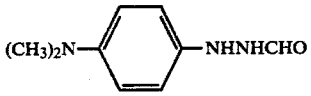

(I-10)

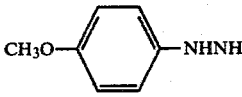

(I-11)

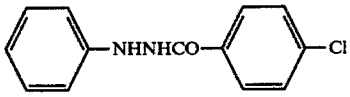

(I-12)

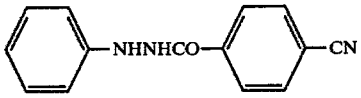

(I-13)

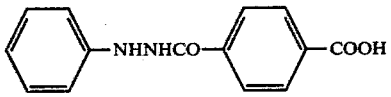

-continued (I-14)

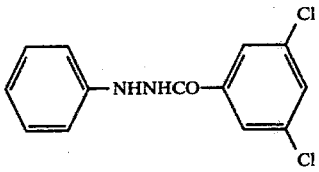

(I-15)

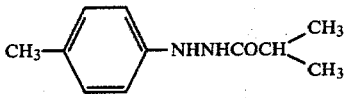

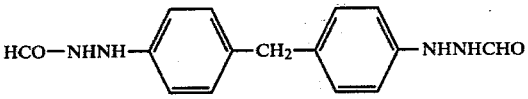

The compounds represented by the general formula (I) can be synthesized by reacting hydrazines with formic acid or by reacting hydrazines with acyl halides. Starting material hydrazines such as

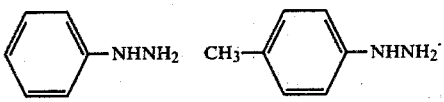

and

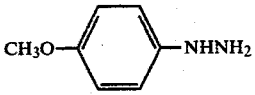

are commercially available and hydrazines of the formula

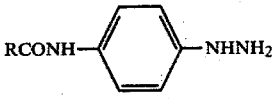

where R represents an alkyl group can be synthesized by reduction of a p-nitrophenylhydrazine. Suitable acyl halides which can be used include aliphatic acyl halides such as acetyl chloride, propionyl chloride, butyryl chloride, etc., and aromatic acyl halides such as benzoyl chloride, toluoyl chloride, etc. The reaction can be conducted in a solvent such as benzene, chloroform, pyridine, triethylamine, etc., and at a temperature of about 0° C. to about 100° C., preferably 0° C. to 70° C. A suitable molar ratio of the hydrazine to the acyl halide in the presence of a base such as pyridine or triethylamine which acts as a hydrogen halide acceptor for the hydrogen halide formed as a by-product ranges from about 1:1 to about 1:3, preferably 1:1.2 to 1:1.5 and in the absence of such a base ranges from about 1:0.3 to about 1:1, preferably 1:0.45 to 1:0.5. Hydrogen halide accepting agents such as triethylamine and pyridine can be employed in an amount of about 1 mol or more per mole of the acyl halide used.

Specific examples of the synthesis of the compounds of the general formula (I) are set forth below. Unless otherwise indicated herein, all parts, percents, ratios and the like are by weight.

SYNTHESIS EXAMPLE 1

Synthesis of Compound (I-2)

110 g of formic acid was stirred at 25° to 30° C., and to this, 107 g of p-tolylhydrazine was gradually added. After completing the addition, heating was performed at 50° C. for 20 minutes while stirring the mixture. After cooling the mixture with ice, the resulting crystals were filtered out and recrystallized from 550 ml of acetonitrile to obtain 54.5 g of colorless needles having a melting point of 176° to 177° C.

SYNTHESIS EXAMPLE II

Synthesis of Compound (I-5)

15 g of p-tolylhydrazine was added to 100 ml of acetonitrile at 25° to 30° C. with stirring. Then, 15 g of benzoyl chloride was added dropwise at 25° to 30° C. After completing the addition, stirring was continued at 25° to 30° C. for 6 hours. After cooling the mixture with ice, the resulting crystals were filtered out and then recrystallized from benzene to obtain 7 g of colorless needles having a melting point of 146° C.

The compound represented by the general formula (I) used in the present invention when employed in a silver halide emulsion or a layer adjacent thereto is present an amount of about $10^{-5}$ to about $5\times10^{-1}$ mol/mol Ag. A preferred amount is $10^{-4}$ to $10^{-1}$ mol/mol Ag.

The addition of the compound represented by the general formula (I) can be carried out using conventional methods of adding additives to photographic emulsions. For example, the compound can be added to the emulsions as an aqueous solution having a suitable concentration where the compound is water soluble or as a solution in an organic solvent compatible with water such as alcohols, ethers, glycols, ketones, esters or amides which do not adversely influence the photographic properties where the compound is insoluble or poorly soluble in water. Known methods similar to the addition of water insoluble couplers (the so-called oil soluble couplers) to emulsions as a dispersion can be used, too.

The compound represented by the general formula (I) used in the present invention when employed in the developer can be present in an amount of about 5 mg to about 5 g per liter of the developer. A preferred amount is 10 mg to 1 g per liter of the developer.

The polyalkylene oxide or the derivative thereof used in the present invention has a molecular weight of at least about 600, and may be employed either in the silver halide light sensitive material or in the developer.

The polyalkylene oxide compounds used in the present invention include condensates between polyalkylene oxides comprising at least 10 units of an alkylene oxide having 2 to 4 carbon atoms, such as ethylene oxide, propylene-1,2-oxide, butylene-1,2-oxide, preferably ethylene oxide, and compounds having at least one active hydrogen atom such as water, aliphatic alcohols, aromatic alcohols, fatty acids, organic amides, organic amines, hexitol derivatives, etc., and block copolymers of two or more polyalkylene oxides. More specifically, suitable polyalkylene oxide compounds which can be used include polyalkylene glycols, polyalkylene glycol alkyl ethers, polyalkylene glycol aryl ethers, polyalkylene glycol alkylaryl ethers, polyalkylene glycol esters, polyalkylene glycol fatty acid amides, polyalkylene glycol amines, polyalkylene glycol block copolymers, polyalkylene glycol graft polymers, etc.

Suitable aliphatic alcohols and aromatic alcohols which can be used can be represented by the general formula (III), (IV) and (V):

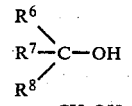
(III)

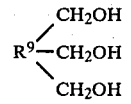
(IV)

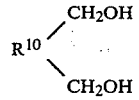
(V)

wherein $R^6$, $R^7$ and $R^8$, which may be the same or different, each represents a hydrogen atom, an alkyl group have 1 to 30 carbon atoms (e.g., $-CH_3$, $-C_2H_5$, $-C_3H_7$, $-C_{11}H_{23}$, $-C_{17}H_{35}$, $-C_{22}H_{45}$, etc.), an aryl group

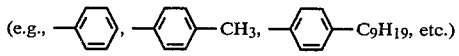

or an alkenyl group (e.g., $C_8H_{17}CH{=}CHC_7H_{14}-$); $R^9$ represents an alkantriyl group having 2 to 30 carbon atoms; and $R^{10}$ represents an alkandiyl group having 2 to 30 carbon atoms.

Suitable phenols which can be used can be represented by the general formulae (VI) to (VIII).

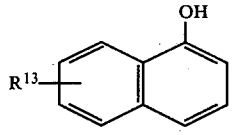
(VI)

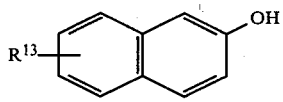
(VII)

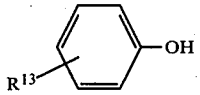
(VIII)

wherein $R^{13}$ represents a hydrogen atom, an alkyl group having 1 to 30 carbon atoms (e.g., $-CH_3$, $-C_2H_5$, $-C_3H_7$, $-C_9H_{19}$. $-C_{11}H_{23}$) or an alkenyl group (e.g., $C_8H_{17}CH{=}CHC_7H_{14}-$, etc.).

Suitable fatty acids which can be used can be represented by the general formulae (IX) and (X):

$$R^{14}COOH \quad \text{(IX)}$$

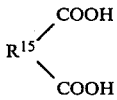
(X)

wherein $R^{14}$ represents an alkyl group having 1 to 30 carbon atoms (e.g., $-CH_3$, $-C_2H_5$, $-C_8H_{17}$, $-C_{11}H_{23}$, $-C_{17}H_{35}$, $-C_{22}H_{45}$, etc.) or an alkenyl group (e.g., $C_8H_{17}CH{=}CHC_7H_{14}$—); and $R^{15}$ represents an alkandiyl group having 2 to 30 carbon atoms.

Suitable organic amides which can be used can be represented by the general formula (XI):

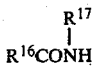

(XI)

wherein $R^{16}$ represents an alkyl group having 1 to 30 carbon atoms (e.g., $-CH_3$, $-C_2H_5$, $-C_3H_7$, $-C_5H_{11}$, $-C_9H_{19}$, $-C_{11}H_{23}$, $-C_{17}H_{35}$, $-C_{22}H_{45}$, etc,) or an aryl group

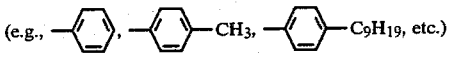

and $R^{17}$ represents a hydrogen atom, an alkyl group having 1 to 30 carbon atoms (e.g., $-CH_3$, $-C_2H_5$, $-C_3H_7$, $-C_5H_{11}$, $-C_9H_{19}$, $-C_{11}H_{23}$, $-C_{17}H_{35}$, $-C_{22}H_{45}$, etc.) or an aryl group

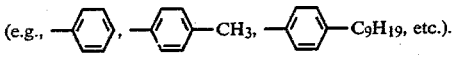

Suitable organic amines which can be used can be represented by the general formula (XII):

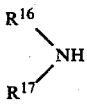

(XII)

wherein $R^{16}$ and $R^{17}$ are the same as defined above for the general formula (XI).

Suitable hexitol derivatives which can be used can be represented by the general formula (XIII):

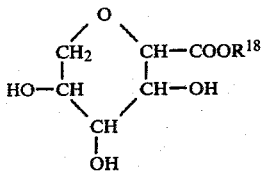

(XIII)

wherein $R^{18}$ represents an alkyl group having 1 to 30 carbon atoms (e.g., $-C_2H_5$, $-C_9H_{19}$, $-C_{11}H_{23}$, $-C_{17}H_{35}$, $-C_{22}H_{45}$, etc.) or an aryl group

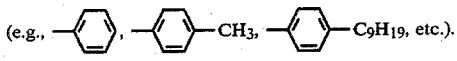

The number of polyalkylene oxide chains is not limited and one, two or more chains may be present in the molecule. In such case, each polyalkylene oxide chain may contain less than 10 alkylene oxide units, but the sum of the alkylene oxide units in the molecule must be at least 10. With compounds containing two or more polyalkylene oxide chains in the molecule, each polyalkylene oxide chain may contain the same alkylene oxide units or alkylene oxide units different from that of the other chain or chains. For example, one chain may comprise ethylene oxide units, and the other chain may comprise propylene oxide units. The polyalkylene oxide compounds used in the present invention preferably contain 14 to 100 alkylene oxide units.

Specific examples of polyalkylene oxide compounds which can be used in the present invention are described below.

Suitable examples of polyalkylene oxide compounds which can be used are those described in Japanese Patent Application (OPI) No. 156,423/50 (corresponding to U.S. Pat. No. 4,011,082), Japanese Patent Application No. 24,783/76 (corresponding to U.S. Patent Application Ser. No. 775,682 filed on Mar. 8, 1977) and Japanese Patent Application No. 76,741/76, such as:

| | |
|---|---|
| PAO-(1) | $HO\text{-}(CH_2CH_2O)_{90}H$ |
| PAO-(2) | $C_4H_9O\text{-}(CH_2CH_2O)_{15}H$ |
| PAO-(3) | $C_{12}H_{25}O\text{-}(CH_2CH_2O)_{15}H$ |
| PAO-(4) | $C_{18}H_{37}O\text{-}(CH_2CH_2O)_{15}H$ |
| PAO-(5) | $C_{18}H_{37}O\text{-}(CH_2CH_2O)_{40}H$ |
| PAO-(6) | $C_8H_{17}CH{=}CHC_8H_{16}O\text{-}(CH_2CH_2O)_{15}H$ |
| PAO-(7) | 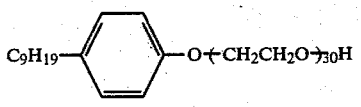 |
| PAO-(8) | 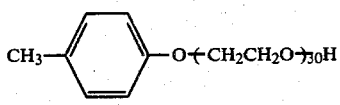 |
| PAO-(9) | 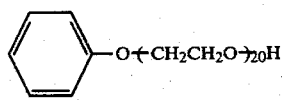 |
| PAO-(10) | $C_{11}H_{23}COO\text{-}(CH_2CH_2O)_{80}H$ |
| PAO-(11) | $C_{11}H_{23}COO\text{-}(CH_2CH_2O)_{24}\overset{\overset{O}{\|}}{C}C_{11}H_{23}$ |
| PAO-(12) | $C_8H_7CH(COO\text{-}(CH_2CH_2O)_{9}H)(COO\text{-}(CH_2CH_2O)_{9}H)$ |
| PAO-(13) | $C_{11}H_{23}CONH\text{-}(CH_2CH_2O)_{15}H$ |

-continued

PAO-(14)

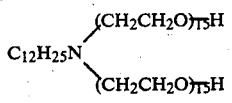

PAO-(15)

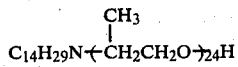

PAO-(16)

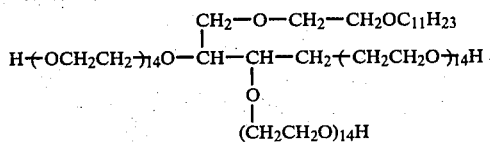

PAO-(17)

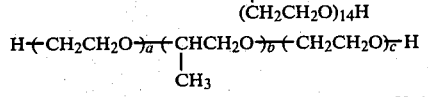

a + b + c = 50; b:(a + c) = 10:9

PAO-(18)

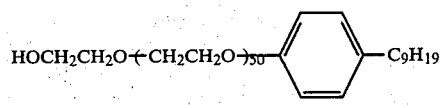

PAO-(19)

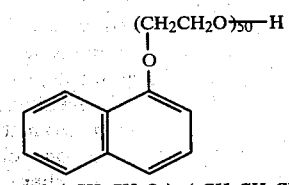

PAO-(20)

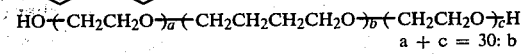

a + c = 30: b = 14

PAO-(21)

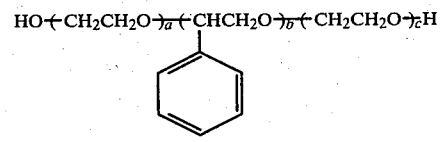

b = 8: a + c = 50

PAO-(22)

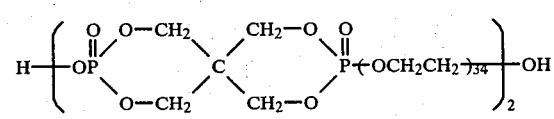

PAO-(23)

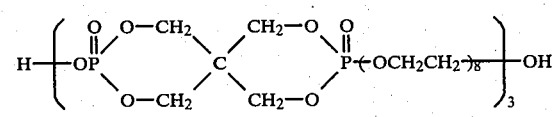

PAO-(24)

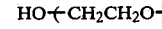

PAO-(25)

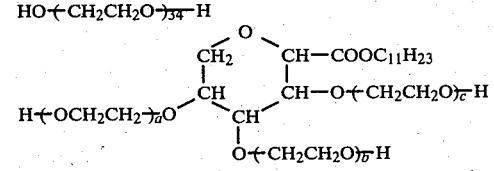

a + b + c = 30

In adding the polyalkylene oxide compound to a silver halide emulsion, it can be added as an aqueous solution of a suitable concentration or as an organic solution by dissolving the polyalkylene oxide compound in a water-miscible organic solvent having a low boiling point as an appropriate stage before coating, preferably after chemical ripening of the silver halide emulsion. The polyalkylene oxide compound may be added to a light-insensitive hydrophilic colloid layer such as an interlayer, a protective layer, a filter layer, etc. instead of the silver halide emulsion, if desired.

In addition, in adding the above-described polyalkylene oxide compound to a developer, it can be added to the developer as a solid or as an aqueous solution of a suitable concentration, or by dissolving the polyalkylene oxide compound in a water-miscible low-boiling organic solvent.

A suitable amount of the polyalkylene oxide compound used in the present invention when employed in the light-sensitive material is about $5\times10^{-4}$ g to 5 g, preferably $1\times10^{-3}$ g to 1 g, per mol of silver halide.

A suitable amount of the polyalkylene oxide compound used in the present invention when employed in a developer is about $1\times10^{-2}$ g or more, preferably $5\times10^{-2}$ g to 40 g, per liter of the developer.

The compound represented by the general formula (II) which is used in one embodiment of the present invention may be incorporated either in a developer or in the silver halide light-sensitive material. Of the compounds represented by the general formula (II), particularly preferable compounds are those wherein $R^3$ represents a hydrogen atom or a nitro group, $R^4$ and $R^5$ each represents a hydrogen atom, a methyl group or an ethyl group.

Specific examples of compounds represented by the general formula (II) include indazole, 5-nitroindazole, 6-nitroindazole, 3-methyl-5-nitroindazole, 3-methyl-6-nitroindazole, 3-methylindazole, 3-ethyl-5-nitroindazole, 3-carboxymethyl-5-nitroindazole, N,N-dimethylaminomethyl-5-nitroindazole, 3-(2-methoxycarbonylethyl)-5-nitroindazole, etc. However, the present invention is not limited only to these compounds.

In incorporating the compound represented by the general formula (II) into the light-sensitive material, it can be dissolved in water or in a water-miscible low-boiling organic solvent in an appropriate concentration, and added as a solution to a silver halide emulsion or to a light-insensitive hydrophilic colloid solution. In addition, well known processes for adding water-insoluble (so-called oil soluble) couplers to an emulsion as a dispersion can also be employed. In adding the compound represented by the general formula (II) to a silver halide photographic emulsion, it may be added in any stage during production of the photographic emulsion, with addition after the completion of chemical ripening of the silver halide photographic emulsion and before coating step being desirable.

Where the compound represented by the general formula (II) is incorporated into the silver halide photographic light sensitive material, a suitable amount is about $5\times10^{-4}$ to $5\times10^{-1}$ mol/mol Ag, preferably $5\times10^{-3}$ to $3\times10^{-1}$ mol/mol Ag.

Where the compound represented by the general formula (II) is incorporated into a developer, it can be dissolved in water or a water-miscible low-boiling organic solvent in a suitable concentration and added to a developer as a solution, or it can be added directly to the developer as a solid. Where the compound represented by the general formula (II) is incorporated in the developer, a suitable amount is about 1 mg/l to 10 g/l, preferably 10 mg/l to 5 g/l.

The average grain size of the silver halide grains which is used in the present invention preferably is less than about 0.7 μ, more particularly less than about 0.4 μ. The term "average grain size" is commonly used by those skilled in the silver halide photographic art and is well understood. The term "grain size" means the diameter of the grains when the grains are spherical or approximately spherical. With cubic grains, the grain size refers to the length of an edge $$x\sqrt{\frac{4}{\pi}}.$$

The average grain size is determined as an algebraic average or geometric average based on the projected area of the grains. Details of the measurement of the average grain size are described in C.E.K. Mees & T.H. James, *The Theory of the Photographic Process,* 3rd. Ed., pp. 36–43, Macmillan, New York (1966).

It is preferred for the silver halide emulsion used in the present invention to contain a binder in an amount of not more than about 250 g per mol of silver halide.

Although gelatin is generally and advantageously used as the binder or protective colloid for the photographic emulsions used in this invention, other hydrophilic colloids may also be used in this invention. For example, proteins such as gelatin derivatives, graft polymers of gelatin with other high molecular weight materials, albumin or casein, etc., cellulose derivatives such as hydroxyethylcellulose, carboxymethylcellulose or cellulose sulfate, etc., saccharide derivatives such as sodium alginate or starch derivatives, etc., and synthetic hydrophilic high molecular weight materials such as homo- or copolymers, for example, polyvinyl alcohol, polyvinyl alcohol partial acetal, poly-N-vinylpyrrolidone, polyacrylic acid, polymethacrylic acid, polyacrylamide, polyvinylimidazole or polyvinylpyrrazole, etc., can be used.

Not only lime processed gelatin but also acid treated gelatin may be used as the gelatin. Further, gelatin hydrolysis products or gelatin enzymatic decomposition products may be used. Those gelatin derivatives which are produced by reacting gelatin with various compounds such as acid halides, acid anhydrides, isocyanates, bromoacetic acid, alkanesultones, vinylsulfonamides, maleinimide compounds, polyalkylene oxides or epoxy compounds, etc., may also be used. Examples of these gelatin derivatives are described in, for example, U.S. Pat. Nos. 2,614,928, 3,132,945, 3,186,846 and 3,312,553, British Patent Nos. 861,414, 1,033,189 and 1,005,784 and Japanese Patent Publication 26845/67.

Examples of the gelatin graft polymers described above which can be used are those produced by grafting gelatin with homo- or copolymers of vinyl monomers such as acrylic acid, methacrylic acid, the esters thereof, the amides thereof, acrylonitrile or styrene, etc. Graft polymers prepared from polymers which are compatible with gelatin, such as polymers of acrylic acid, methacrylic acid, acrylamide, methacrylamide or hydroxyalkyl methacrylates, etc., are particularly preferred. Examples of graft polymers are described in U.S. Pat. Nos. 2,763,625, 2,831,767 and 2,956,884, etc. Typical synthetic hydrophilic high molecular weight materials are those described in German Patent Application (OLS) 2,312,708, U.S. Pat. Nos. 3,620,751 and 3,879,205 and Japanese Patent Publication 7561/68.

Although the silver halide emulsions used in the present invention do not need to be chemically sensitized, chemically sensitized silver halide emulsions are preferred. Processes for the chemical sensitization of silver halide emulsions which can be used include known sulfur sensitization, reduction sensitization and noble metal sensitization processes. In noble metal sensitization processes, a gold sensitization process is a typical process where a gold compound, or mainly gold complexes are used. Compounds of noble metals other than gold such as platinum, palladium or iridium, etc., can be advantageously used. A reduction sensitization process can be used if the process does not generate fog to an extent which causes practical difficulties. Suitable sensitization processes are described in references such as P. Glafkides, *Chimie et Phisique Photographique,* Paul Montel, Paris (1967) or Zelikman, *Making and Coating Photographic Emulsions,* The Focal Press, London (1964) or H. Frieser, *Die Grundlagen der photographischen Prozesse mit Silverhalogeniden,* Akademische Verlagsgesellschaft (1968).

Examples of sulfur sensitizing agents which can be used include not only the sulfur compounds present in gelatin per se but also various sulfur compounds such as thiosulfates, thioureas, thiazoles or rhodanines, etc. Examples of suitable sulfur compounds are described in U.S. Pat. Nos. 1,574,944, 2,410,689, 2,278,947, 2,728,668 and 3,656,955. Typical examples of reduction sensitizing agents which can be used include stannous salts, amines, formamidine sulfinic acid and silane compounds, etc., as described in U.S. Pat. Nos. 2,487,850, 2,518,698, 2,983,609, 2,983,610 and 2,694,637. Complex salts of metals of Group VIII of the Periodic Table, such as gold, platinum, iridium or palladium, etc., can be used for noble metal sensitization and examples thereof are described in U.S. Pat. No. 2,448,060 and British Patent No. 618,061, etc.

The photographic emulsion used in this invention can be prepared using the methods described in, e.g., P. Grafkides, *Chimie et Physique Photographique,* Paul Montel, Paris (1967), G. F. Duffin, *Photographic Emulsion Chemistry,* The Focal Press, London (1966), V. L. Zelikman et al., *Making and Coating Photographic Emulsions,* The Focal Press, London (1964), etc. That is, any of the acid method, the neutral method, the ammonia method and other methods can be used. Moreover, the reaction of a soluble silver salt with a soluble halogen salt can be accomplished using any of the single jet method, the double jet method and a combination thereof.

The method in which grains are formed in the presence of an excess of silver ions (the so-called reverse mixing method) can also be used. One of the modes of the double jet method is a method in which the pAg of the liquid phase in which the silver halide is to be produced is kept constant, that is, the so-called controlled double jet method, can be used. This method can be used to produce silver halide emulsions having a regular crystal form and an substantially uniform grain size.

The silver halide grains in the photographic emulsion used in this invention can have a relatively wide grain size distribution, but a narrow grain size distribution is preferred. In particular, 90% by weight of or 90% on a number basis of the total silver halide grains preferably has a grain size within ±40% of the average grain size (such an emulsion is usually called a monodispersed emulsion).

The silver halide grains in the photographic emulsion used in this invention may have a regular form such as cubic crystals or octahedral crystals, or may have an irregular form such as spherical crystals or plate-like crystals, or may have a composite crystal form of these crystal forms. The grains may comprise mixed grains with various crystal forms.

The interior and the surface layer of the silver halide grain may be different or the grains may be uniform throughout.

In the process of the formation of silver halide grains or physical ripening, cadmium salts, zinc salts, lead salts, thallium salts, rhodium salts or complex salts thereof, iron salts or iron complex salts, and the like can be present.

Two or more of silver halide emulsions which are separately prepared can be mixed and then used, if desired.

After the formation of the grains or after physical ripening, the soluble salts are usually removed from the emulsion. For this purpose, the well-known noodle washing method in which gelatin is subjected to gelation may be used. Furthermore, a flocculation method which employs an inorganic salt having a polyvalent anion such as sodium sulfate, an anionic surface active agent, an anionic polymer (such as polystyrene sulfonic acid) or a gelatin derivative (such as an aliphatic acylated gelatin, an aromatic acylated gelatin or an aromatic carbamoylated gelatin) may be used. The removal of the soluble salts may be omitted, if desired.

The effect of this invention is enhanced even more by adding a small amount of an iodide (such as potassium iodide) to the silver halide emulsion after the formation of the silver halide grains, before chemical ripening, after chemical ripening or before coating. A suitable amount of the iodide added ranges from about $10^{-4}$ to about $10^{-2}$ mol/mol Ag.

The silver halide emulsions used in the present invention may contain anti-fogging agents. Such emulsions are preferred in order to attain the objects of the present invention. Examples of preferred anti-fogging agents which can be used in the emulsions used in the present invention include 1,2,3-triazole compounds, 3-mercapto-substituted 1,2,4-triazole compounds, 2-mercaptobenzimidazole compounds, 2-mercaptopyrimidines, 2-mercaptobenzothiazoles, benzothiazolium compounds (for example, N-alkylbenzothiazolium halides or N-allylbenzothiazolium halides), 2-mercapto-1,3,4-thiadiazoles and 4-mercapto-1,3,3a,7-tetrazaindenes.

Particularly preferred anti-fogging agents for use in the present invention are benzotrizoles. The benzene ring thereof may be substituted with alkyl groups (for example, a methyl group or a heptyl group) or halogen atoms (for example, a chlorine atom or a bromine atom). The alkyl moiety of these substituents preferably has 12 or less carbon atoms and, particularly, 3 or less carbon atoms. Further, the 1-position of the benzotriazole may be substituted with a halogen atom (for example, a chlorine atom or a bromine atom).

The silver halide photographic light-sensitive materials which can be used in the present invention may contain hydroxytetrazaindene compounds. The effect of the present invention, such as increasing the sensitivity, increasing the contrast and improving the dot quality can be enhanced further by incorporating such a hydroxytetrazaindene compound into the emulsion. Suitable hydroxytetrazaindene compounds include 4-hydroxy-1,3,3a,7-tetrazaindene compounds and a particularly useful compound is 4-hydroxy-6-methyl-1,3,3a,7-tetrazaindene.

The photographic emulsions used in this invention can be spectrally sensitized with methine or other dyes. Suitable sensitizing dyes include cyanine dyes merocyanine dyes, complex cyanine dyes, complex merocyanine dyes, holopolar cyanine dyes, hemicyanine dyes, styryl dyes and hemioxonol dyes. Particularly useful dyes are cyanine dyes, merocyanine dyes and complex merocyanine dyes. These dyes can contain, as a basic heterocyclic nucleus, any of the nuclei which are usually employed in cyanine dyes. That is, a pyrroline nucleus, an oxazoline nucleus, a thiazoline nucleus, a pyrrole nucleus, an oxazole nucleus a thiazole nucleus, a selenazole nucleus, an imidazole nucleus, a tetrazole nucleus, a pyridine nucleus and the like; nuclei as described above condensed with an alicyclic hydrocarbon ring; and nuclei as described above condensed with an aromatic hydrocarbon ring, such as an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus and a quinoline nucleus. The carbon atoms of the above-described nuclei may be substituted.

The merocyanine dyes or complex merocyanine dyes can contain, as a nucleus having a ketomethylene structure, a 5- to 6-membered heterocyclic nucleus such as a pyrazolin-5-one nucleus, a thiohydantoin nucleus, a 2-thiooxazolidone-2,4-dione nucleus, a thiazolidine-2,4-dione nucleus, a rhodanine nucleus or a thiobarbituric acid nucleus.

Useful sensitizing dyes are those described in, e.g., German Pat. No. 929,080, U.S. Pat. Nos. 2,231,658, 2,493,748, 2,503,776, 2,519,001, 2,912,329, 3,656,959, 3,672,897 and 3,694,217, British Pat. No. 1,242,588, Japanese Patent Publication 14,030/69, etc.

These sensitizing dyes may be used individually or as a combination thereof. A combination of sensitizing dyes is often employed particularly for the purpose of supersensitization. Typical examples of such combinations are described in, e.g., U.S. Pat. Nos. 2,688,545, 2,977,229, 3,397,060, 3,522,052, 3,527,641, 3,617,293, 3,628,964, 3,666,480, 3,679,428, 3,703,377, 3,769,301, 3,814,609 and 3,837,862, British Pat. No. 1,344,281, Japanese Patent Publication 4,936/68, etc.

The sensitizing dyes may be present in the emulsion together with dyes which themselves do not give rise to any spectral sensitizing effects but exhibit a supersensitizing effect when used in combination or materials which do not substantially absorb visible light but exhibit a supersensitizing effect when used in combination. For example, aminostilbene compounds substituted with a nitrogen-containing heterocyclic ring (e.g., those described in U.S. Pat. Nos. 2,933,390 and 3,635,721), aromatic organic acid-formaldehyde condensates (e.g., those described in U.S. Pat. No. 3,743,510), azaindene compounds, and the like, can be present. The combinations described in U.S. Pat. Nos. 3,615,613, 3,615,641, 3,617,295 and 3,635,721 are particularly useful.

A water-soluble dye may be present in any of the hydrophilic colloid layers in the photographic light-sensitive material used in this invention as a filter dye or for prevention of light scattering, antihalation or various other purposes. Examples of these dyes include oxonol dyes, hemioxonol dyes, styryl dyes, merocyanine dyes, cyanine dyes and azo dyes. Of these dyes, oxonol dyes, hemioxonol dyes and merocyanine dyes are particularly useful. Specific examples of dyes which can be used are those described in British Pat. Nos. 584,609 and 1,177,429, Japanese Patent Application (OPI) Nos. 85,130/73, 99,620/74 and 114,420/74, and U.S. Pat. Nos. 2,274,782, 2,533,472, 2,956,879, 3,148,187, 3,177,078, 3,247,127, 3,540,887, 3,575,704, 3,653,905 and 3,718,472.

An inorganic or organic hardener may be present in any of the hydrophilic colloid layers in the light-sensitive material used in this invention. For example, chromium salts (such as chrome alum or chromium acetate), aldehydes (such as formaldehyde, glyoxal or glutaraldehyde), N-methylol compounds (such as dimethylolurea or methyloldimethylhydantoin), dioxane derivatives (such as 2,3-dihydroxydioxane), active vinyl compounds (such as 1,3,5-triacryloyl-hexahydro-s-triazine or bis(vinylsulfonyl)-methyl ether), active halogen compounds (such as 2,4-dichloro-6-hydroxy-s-triazine), mucohalic acids (such as mucochloric acid or mucophenoxychloric acid), isooxazoles, dialdehyde starch, 2-chloro-6-hydroxytriazinylated gelatin and the like can be used individually or in combination. Specific examples of these compounds are described in, e.g., U.S. Pat. Nos. 1,870,354, 2,080,019, 2,726,162, 2,870,013, 2,983,611, 2,992,109, 3,047,394, 3,057,723, 3,103,437, 3,321,313, 3,325,287, 3,362,827, 3,539,664 and 3,543,292, British Pat. Nos. 676,628, 825,544, and 1,270,578, German Pat. Nos. 872,153 and 1,090,427, Japanese Patent Publications 7,133/69 and 1,872/71, etc.

The light-sensitive material of this invention may contain various known surface active agents for various purposes, e.g., as a coating aid, for preventing the generation of static charges, improving slip characteristics, improving emulsion dispersion, preventing adhesion, improving photographic characteristics (e.g., accelerating development, increasing contrast, sensitization), etc.

For example, nonionic surface active agents such as saponin (steroids), glycidol derivatives (such as alkenylsuccinic acid polyglycerides or alkylphenol polyglycerides), aliphatic esters of polyvalent alcohols, alkyl esters of sucrose, urethanes or ethers; anionic surface active agents containing an acidic group such as a carboxy group, a sulfo group, a sulfuric acid ester group or a phosphoric acid ester group, such as triterpenoid type saponin, alkylcarboxylates, alkylsulfonates, alkylbenzenesulfonates, alkylnaphthalenesulfonates, alkylsulfates, alkylphosphates, N-acyl-N-alkyltaurines, sulfosuccinates, sulfoalkylpolyoxyethylene alkylphenyl ethers or polyoxyethylene alkylphosphates; amphoteric surface active agents such as amino acids, aminoalkylsulfonic acids, aminoalkylsulfuric acid esters, aminoalkyl phosphoric acid esters, alkylbetaines, amineimides or amine oxides; and cationic surface active agents such as alkylamine salts, aliphatic or aromatic quaternary ammonium salts, (such as pyridinium or imidazolium salts) or phosphonium or sulfonium salts containing an alicyclic or heterocyclic ring can be used.

Specific examples of these surface active agents are described in, e.g., U.S. Pat. No. 3,507,660, British Pat. Nos. 1,012,495, 1,022,878, 1,179,290 and 1,198,450, Japanese Patent Application (OPI) No. 117,414/75, U.S. Pat. Nos. 2,739,891, 3,666,478, 3,133,816, 3,475,174, 3,726,683, 3,589,906 and 3,754,924, Belgian Pat. No. 731,126, British Pat. Nos. 1,138,514, and 1,374,780, German Patent Application (OLS) No. 1,961,638, Japanese Patent Application (OPI) No. 59,025/75, etc.

The photographic emulsion used in this invention can contain a dispersion of a synthetic polymer which is insoluble or slightly soluble in water for the purpose of improving the dimensional stability, or other purposes. Examples of polymers which can be used include polymers composed of one one or more alkyl acrylates or methacrylates, alkoxyalkyl acrylates or methacrylates, glycidyl acrylates or methacrylates, acryl or methacrylamide, vinyl esters (for example, vinyl acetate), acrylonitrile, olefins and styrene, etc., and polymers comprising a combination of the above-described monomers and acrylic acid, methacrylic acid, $\alpha,\beta$-unsaturated dicarboxylic acids, hydroxyalkyl acrylates or methacrylates or styrene-sulfonic acid, etc. For example, those compounds described in U.S. Pat. Nos. 2,376,005, 2,739,137, 2,853,457, 3,062,674, 3,411,911, 3,488,708, 3,525,620, 3,607,290, 3,635,715 and 3,645,740 and British Pat. Nos. 1,186,699 and 1,307,373 can be used. A suitable amount of the polymer ranges from about 20 to 80% by weight based on the total weight of the binders. Since high contrast emulsions such as that used in this invention are suitable for the reproduction of line drawings and the dimensional stability is of importance for such a purpose, it is preferred for the above-described polymer dispersion to be employed.

The photographic emulsions can be coated on conventional supports which do not undergo serious dimensional changes during processing. Typical supports which can be used are a cellulose acetate film, a polystyrene film, a polyethylene terephthalate film, a polycarbonate film, a laminate thereof, paper, baryta paper, paper coated or laminated with a hydrophobic polymer such as polyethylene, polypropylene, etc., as are commonly used for photographic light-sensitive materials. Transparent supports can be employed for certain end-uses of the light-sensitive material. Also, transparent supports may be colored by adding a dye or a pigment thereto as described in *J. SMPTE,* 67, 296 (1958), etc.

Where the adhesion between the support and the photographic emulsion layer(s) is insufficient, a subbing layer (an adhesive layer adhesive to both the support and the photographic emulsion layer(s)) is employed. Also, in order to improve the adhesion, the surface of the support may be subjected to a preliminary processing such as a corona discharge, an irradiation with ultraviolet light, a flame treatment, etc. A suitable coating amount of silver is about 0.5 g/m$^2$ to about 10 g/m$^2$ of the support.

Exposure to light for obtaining a photographic image can be performed in a conventional manner. Various known light sources such as natural light (sunlight), a tungsten lamp, a fluorescent light, a mercury lamp, a xenon arc lamp, a carbon arc lamp, a xenon flash lamp or a cathode ray tube flying spot can be used. The exposure time can, of course, be about 1/1,000 sec to about 1 sec which is usually employed with cameras, and further, exposure for shorter than about 1/1,000 sec, for example, about 1/10$^4$ to about 1/10$^6$ sec which is employed in case of using a xenon flash lamp or a cathode ray tube, and exposure for longer than about 1 sec can be employed. If desired, the spectral composition of the light used for the exposure can be controlled using a color filter. The fluorescence resulting from the excitation of a phosphor caused by ionizing radiation or a laser beam can also be used for exposure. Moreover, exposure to electron beams, X-rays, $\gamma$-rays or $\alpha$-rays may be employed.

The photographic light-sensitive material used in this invention can be photographically processed using known methods and known processing solutions. The processing temperature usually ranges from about 18° to about 50° C., but temperatures lower than about 18° C. or higher than about 50° C. may be used. This invention is useful for the formation of an image by development in which a silver image is formed (a black-and-white photographic processing).

The developer used in the present invention must contain more than 0.18 mol/l of free sulfite ions and substantially contain only dihydroxybenzenes as the developing agent. A preferred free sulfite ion concentration in the developer is more than 0.25 mol/l.

Suitable examples of dihydroxybenzenes, which can be used as the developing agent include hydroquinone, chlorohydroquinone, bromohydroquinone, isopropylhydroquinone, methylhydroquinone, 2,3-dichlorohydroquinone or 2,5-dimethylhydroquinone, etc. Of dihydroxybenzenes, hydroquinone is preferred for practical use. The above-described developing agents can be used individually or as a combination thereof. A suitable amount of the developing agent ranges from about 2 g to 80 g per liter of the developer. An amount of 5 g to 60 g/l is preferred.

The developer used in the present invention substantially contains a dihydroxybenzene alone as a developing agent. As an auxiliary developing agent for dihydroxybenzenes, 1-phenyl-3-pyrazolidone and the derivatives thereof, or N-methyl-p-aminophenol and the derivatives thereof, well known to those skilled in the art, can be employed. However, if these auxiliary developing agents are added in a large amount to the developer, the object of the present invention of improving the dot quality is difficult to attain. Therefore, the auxiliary developing agents preferably are not incorporated in the developer in an amount of more than would prevent the effects of the present invention. For example, the amount of auxiliary developing agent should be less than about 0.5 g/l, preferably less than 0.3 g/l, of the developer.

In addition, the developer generally contains known additives such as a preservative, an alkali agent, a pH buffer, an antifogging agent and, if necessary, the developer may further contain an organic solvent, a toning agent, a development accelerator, a surface active agent, a defoaming agent, a water softener, a hardener, a thickening agent, etc.

Suitable fixing solutions which can be used are those conventionally used. Suitable fixing agents which can be used include thiosulfates, thiocyanates and, in addition, organic sulfur compounds known as fixing agents can be used. The fixing solution may contain a water-soluble aluminum salt as a hardener, if desired.

The processing temperature is usually selected between about 18° C. and about 50° C. However, temperatures lower than about 18° C. or higher than about 50° C. may also be employed.

The present invention is now illustrated in greater detail by reference the following examples which, however, are not to be construed as limiting the present invention in any way. Unless otherwise indicated, all parts, percents, ratios and the like are by weight.

EXAMPLE 1

A silver halide aqueous solution and a potassium bromide aqueous solution were simultaneously added to a gelatin aqueous solution maintained at 50° C. over a 50 minute period, during which period the pAg was maintained at 7.9. Thus, a silver bromide emulsion having an average grain size of 0.25$\mu$ was obtained. After removing the soluble salts in a conventional manner, this emulsion was chemically sensitized for 60 minutes at 60° C. by adding 43 mg of sodium thiosulfate per mol of silver bromide. This emulsion contained 120 g of gelatin per mol of silver. After adding to this emulsion 5-methylbenzotriazole (as an antifogging agent) and, further, 2-hydroxy-4,6-dichloro-1,3,5-triazine sodium salt (as a hardener), the resulting mixture was coated on a cellulose triacetate film in an amount of 45 mg of silver per 100 cm$^2$:

This film sample was designated Film No.1. For the purpose of comparison, a second sample, Film No. 2, was prepared in the same manner as Film No.1 except for incorporating $1.0\times10^{-3}$ mol/mol Ag of Compound (I-2) as one of the compounds represented by the general formula (I) used in the present invention.

For the purpose of further comparison, a third sample, Film No.3, was prepared in the same manner as Film No.1 except for incorporating 0.4 g/mol Ag of PAO-(7) as a polyalkylene oxide derivative. For still a further comparison, a fourth sample, Film No.4, was prepared in the same manner as Film No.1 except for incorporating $1.0\times10^{-3}$ mol/mol Ag of Compound (I-2) as one of the compounds represented by the general formula (I), used in the present invention, and 0.4 g/mol Ag of PAO-(7) as a polyalkylene oxide derivative. These films were sensitometrically exposed using a 150-line magenta contact screen.

After exposing through a wedge, the samples were developed for 1 minute and 45 seconds at 27° C. in the following two developers having the following compositions using an automatic developing machine, FG14L (made by Fuji Photo Film Co., Ltd.), then fixed, washed and dried. Further, in order to compare the stability of the developers, the samples were developed in the same manner after allowing the developers to stand in the automatic developing machine for 4 days to examine the photographic characteristics.

Developer A

| | |
|---|---|
| Tetrasodium Ethylenediamine-tetraacetate | 1.0 g |
| Potassium Bromide | 5.0 g |
| Sodium Sulfite | 75.0 g |
| Hydroquinone | 28.0 g |
| Sodium Carbonate (monohydrate) | 12.0 g |
| Potassium Hydroxide | 25.0 g |
| Water to make | 1 liter |

Developer B

Prepared by adding 50 mg of 5-nitroindazole to Developer A per liter of the developer.

For the purpose of comparison, a commercially available lithographic film was exposed in the same manner as above, and developed in Lithographic Developer C having the following composition using the same automatic developing machine, FG14L.

Lithographic Developer C

| | |
|---|---|
| Sodium Formaldehyde-Bisulfite Adduct | 50.0 g |
| Hydroquinone | 15.0 g |
| Sodium Sulfite | 2.0 g |
| Potassium Carbonate | 30.0 g |
| Potassium Bromide | 3.0 g |
| Boric Acid | 4.0 g |
| Sodium Hydroxide | 4.0 g |
| Triethylene Glycol | 40.0 g |
| Water to make | 1 liter |

The results obtained are shown in Table 1 below.

TABLE 1

| Run No. | Film Sample | Developer | Compound (I-2) | Polyalkylene Oxide Derivative | Photographic Characteristics of Fresh Solution S | DQ | Photographic Characteristics of Fresh S | DQ |
|---|---|---|---|---|---|---|---|---|
| 1 | Film No. 1 | Developer A | Not present | Not present | 50 | 5 | 50 | 5 |
| 2 | Film No. 2 | Developer A | Present | Not present | 100 | 4 | 100 | 4 |
| 3 | Film No. 3 | Developer A | Not present | Present | 50 | 4 | 50 | 4 |
| 4 | Film No. 4 | Developer A | Present | Present | 100 | 2 | 100 | 2 |
| 5 | Film No. 4 | Developer B | Present | Present | 50 | 1 | 50 | 1 |
| 6 | Commercially Available Lithographic Film | Lithographic Developer C | — | — | 100 | 2 | 50 | 3 |

S = Sensitivity
DQ = Dot quality

In Table 1, the sensitivities are indicated as relative values taking the sensitivity obtained by developing the commercially available lithographic film with fresh Lithographic Developer C as 100.

The dot quality was visually rated in 5 grades, with "1" showing the best quality and "5" showing the worst quality. For dot plates for plate-making, a dot quality of a grade of "1" and "2" only is practically usable, and a dot quality of a grade of "3", "4" and "5" are practically unsatisfactory dot qualities.

As is shown by the results in Table 1, with the system of combining the conventional lithographic film with the lithographic developer (shown as Run No.6), the reduction in sensitivity was serious when the stored developer was used, although good dot quality was obtained when the fresh developer was used. Since Developers A and B had sufficiently high sulfite concentrations, the sensitivities of Run Nos. 1, 2, 3, 4 and 5 obtained by using fresh Developer A or B were the same as that obtained by using stored Developer A or B. Thus, it is seen that the stabilities of both developers were high. However, the dot quality of the sample of Run No.1 was extremely unsatisfactory. Also, since the sample of Run No.2 contained only the compound represented by the general formula (I) used in the present invention, a practically insufficient dot quality was obtained, though the dot quality was improved to some extent as compared with the sample of Run No.1. In addition, tonal gradation was so contrasty that is was practically unsatisfactory.

The sample of Run No.3 containing the polyalkylene oxide derivative alone had a practically insufficient dot quality though the dot quality was improved to some extent as compared with the sample of Run No.1.

On the other hand, the sample of Run No.4 in accordance with the present invention was developed in the presence of both the compound represented by the general formula (I) and the polyalkylene oxide derivative used in the present invention to obtain the same dot quality and tonal gradation as that obtained with the conventional combination of the lithographic film and the lithographic developer. This is a marked effect which would not have been expected from the effect obtained by using the compound represented by the general formula (I) or the polyalkylene oxide derivative independently. In addition, as is shown in Run No.5, the use of Developer B to which the compound represented by the general formula (II) used in the present invention had been further added to the developer provided superior dot quality than that obtained with the conventional combination of the lithographic film and the lithographic developer. Further, strong drag streaks occurred in the sample of Run No. 6 of the conventional combination of the lithographic film and the lithographic developer whereas no drag streaks at all occurred with the samples of Run No. 4 and 5 in accordance with the present invention.

EXAMPLE 2

An aqueous solution of silver nitrate and an aqueous solution containing potassium iodide and potassium bromide were simultaneously added to a gelatin aqueous solution maintained at 60° C. over a 50 minute period, during which period the pAg was maintained at 7.7 to prepare a silver bromoiodide emulsion of an average grain size of 0.20μ. This emulsion contained 0.02 mol of iodide per mol of silver. After removing the soluble salts in a conventional manner, 50 mg of sodium thiosulfate was added thereto per mol of the silver bromoiodide and the emulsion was chemically ripened at 60° C. for 60 minutes.

This emulsion contained 72 g of gelatin per mol of silver bromoiodide.

This emulsion was separated into three portions. To one of the portions were added 0.2 g of PAO-(18) as a polyalkylene oxide compound, 1.1 g of 5-nitroindazole and $5.0\times10^{-3}$ mol of Compound (I-4) of the general formula (I) per mol of silver bromoiodide. The resulting emulsion was designated Emulsion A. To the second portion was added Compound (I-4) of the general formula (I) alone in the same amount as in Emulsion A. The resulting emulsion was designated Emulsion B. To the third portion were added PAO-(18) as a polyalkylene oxide derivative, and 5-nitroindazole in the same amounts as in Emulsion A. The resulting emulsion was designated Emulsion C. To each of Emulsions A, B and C were added 5-methylbenzotriazole (as an anti-fogging agent), a polymethyl acrylate dispersion (as a dimension-stabilizing agent) and 2-hydroxy-4,6-dichloro-1,3,5-triazine sodium salt (as a hardener), and the emulsions were coated on polyethylene terephthalate films in amounts of 45 mg of silver per 100 cm². These films were subjected to the same screen exposure as described in Example 1, and developed with Developer A as described in Example 1 (Emulsions A and C) or with Developer D having the following composition (Emulsion B).

Developer D

Prepared by adding 50 mg of 5-nitroindazole and 2 g of PAO-(18) as a polyalkylene oxide derivative per liter of Developer A as described in Example 1. The results obtained are shown in Table 2 below.

TABLE 2

| Run No. | Emulsion | In Emulsion *1 | In Emulsion *2 | In Emulsion *3 | In Developer *4 | In Developer *5 | Sensitivity | Dot Quality |
|---|---|---|---|---|---|---|---|---|
| 7 | A | Present | Present | Present | Not present | Not present | 100 | 1 |
| 8 | B | Present | Not present | Not present | Present | Present | 100 | 1 |
| 9 | C | Not pres- | Present | Present | Not pres- | Not pres- | 45 | 4 |

TABLE 2-continued

| Run No. | Emulsion | In Emulsion *1 | In Emulsion *2 | In Emulsion *3 | In Developer *4 | In Developer *5 | Sensitivity | Dot Quality |
|---|---|---|---|---|---|---|---|---|
| | | ent | | | ent | ent | | |

*1 Compound (I-4)
*2 Polyalkylene Oxide Derivative
*3 5-Nitroindazole
*4 Polyalkylene Oxide Derivative
*5 5-Nitroindazole The sensitivities in Table 2 are relative values taking the sensitivity of Run No. 8 as 100. The dot quality was rated in the same manner as in Example 1.

As is shown by the results in Table 2, Run Nos. 7 and 8 in accordance with the developing process of the present invention provided about the same sensitivities and dot qualities. Thus, it is seen that the polyalkylene oxide derivative and the indazole compound used in the present invention provided advantageous results when present in either the emulsion or the developer. In addition, as is shown by Run No. 9, where the compound represented by the general formula (I) used in the present invention was not employed, low sensitivity and unfavorable dot quality were obtained.

EXAMPLE 3

A fine grain gelatino-silver bromochloride lithographic emulsion containing 25 mol % silver bromide and 75 mol % silver chloride was spectrally sensitized to green light. This emulsion was coated on a polyethylene terephthalate film support. After exposing this film through an exposure wedge for sensitometry using a 150-line magenta contact screen, the film was developed in various developers of the following compositions.

| Composition | Developer E | F | G | H | I | J |
|---|---|---|---|---|---|---|
| Hydroquinone | 15 g | 15 g | 15 g | 15 g | 15 g | 15 g |
| Sodium Sulfite (Anhydrous) | 20 g | 40 g | 40 g | 40 g | 40 g | 40 g |
| Potassium Carbonate | 70 g | 70 g | 70 g | 70 g | 70 g | 70 g |
| Potassium Bromide | 1 g | 1 g | 1 g | 1 g | 1 g | 1 g |
| Polyethylene Glycol (average molecular weight: 1500) | 1 g | 1 g | 1 g | — | 1 g | 1 g |
| 5-Nitroindazole | 20 mg | 20 mg | — | — | — | 20 mg |
| Boric Acid | 8 g | 8 g | 8 g | 8 g | 8 g | 8 g |
| Compound (I-10) | — | — | — | 0.3 g | 0.3 g | 0.3 g |
| Water to make | 1 l | 1 l | 1 l | 1 l | 1 l | 1 l |

Development of the film was conducted at 32° C. for 58 seconds in each of Developers E, F, G, H, I and J using an automatic developing machine, FG14L. In order to compare the stability of the developers, the photographic characteristics on development after allowing the developers to stand in the automatic developing machine for 4 days were obtained. As a result, the photographic characteristics shown in Table 3 were obtained.

TABLE 3

| Developer | Photographic Characteristics with Fresh Solution: Sensitivity | Photographic Characteristics with Fresh Solution: Dot Quality | Photographic Characteristics with Stored Solution: Sensitivity | Photographic Characteristics with Stored Solution: Dot Quality |
|---|---|---|---|---|
| E | 100 | 2 | 50 | 4 |

TABLE 3-continued

| Developer | Photographic Characteristics with Fresh Solution | | Photographic Characteristics with Stored Solution | |
|---|---|---|---|---|
| | Sensitivity | Dot Quality | Sensitivity | Dot Quality |
| F | 100 | 4 | 100 | 4 |
| G | 150 | 4 | 150 | 4 |
| H | 300 | 4 | 300 | 4 |
| I | 200 | 2 | 200 | 2 |
| J | 150 | 1 | 150 | 1 |

In the above table, the dot qualities are indicated in the same manner as in Example 1, and the sensitivities are relative taking the sensitivity obtained by using fresh Developer E as 100.

With Developer H of the invention, the dot quality was extremely poor although a gamma value of as high as above 10 was obtained. This may be because the developing effect in the dot areas does not advantageously function to provide good dot quality. On the other hand, with Developer I used in the present invention, good photographic characteristics with high gamma value and good dot quality were obtained. This may be because the development effect in the small areas like those of a size of 0.01 to 0.02 $cm^2$ is advantageous with good dot quality being obtained. Developer E is the developer shown in the example disclosed in Japanese Patent Application (OPI) No. 19,836/72. This developer does not possess sufficient stability and, when left for 4 days in an automatic developing machine, serious reduction in sensitivity occurs where it is used. On the other hand, Developer F prepared by increasing the amount of anhydrous sodium sulfite as compared with Developer E results in serious deterioration of dot quality when it is used though the stability is improved to some extent. Developer G containing only polyethylene glycol of the compounds used in the present invention provided unsatisfactory dot quality. Developer H containing Compound (I-10) of the general formula (I) of the compounds used in the present invention provided unsatisfactory dot quality. On the other hand, with Developer I of the present invention, development was conducted in the presence of both Compound I-10 of the general formula (I) and the polyalkylene oxide derivative used in the present invention, and a dot image having the same dot quality as that obtained by the combination of a conventional lithographic film and a lithographic developer was obtained. This is an excellent effect which cannot be expected from that obtained by the compound represented by the general formula (I) used in the present invention or the polyalkylene oxide derivative independently. In addition, it can be seen that the dot quality was further improved in Developer J additionally containing 5-nitroindazole.

While the present invention has been described in detail and with reference to specific embodiments thereof, it is apparent to one skilled in the art that various changes and modifications can be made therein without departing from the spirit and the scope of the present invention.

What is claimed is:

1. A process for producing a high contrast negative photographic image comprising developing an imagewise exposed silver halide photographic light-sensitive material with a developer containing (a) free sulfite ion in a concentration of at least 0.18 mol/l and (b) a dihydroxybenzene as the sole developing agent in the presence of at least one polyalkylene oxide having a molecular weight of at least 600 or a derivative thereof wherein said polyalkylene oxide is contained in said light-sensitive material or in said developer and wherein said silver halide photographic light-sensitive material comprises a support having thereon at least one silver halide emulsion layer and wherein the light-sensitive material or said developer contains at least one compound represented by the following general formula (I):

$$R^1NHNHCOR^2 \quad (I)$$

wherein $R^1$ represents an aryl group; $R^2$ represents a hydrogen atom, a phenyl group or an unsubstituted alkyl group having 1 to 3 carbon atoms in an amount of about $10^{-5}$ to $10^{-1}$ mol/mol of Ag and the silver halide is selected from the group consisting of silver chloride, silver chlorobromide, silver bromide, silver iodobromide and silver iodochlorobromide and the average grain size of said silver halide is about 0.7 micron or less.

2. The process of claim 1, wherein the light-sensitive material or the developer additionally contains at least one compound represented by the following general formula (II);

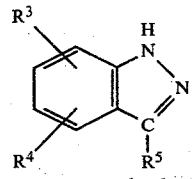

(II)

wherein $R^3$ represents a hydrogen atom or a nitro group, and $R^4$ and $R^5$, which may be the same or different, each represents a hydrogen atom or an alkyl group having 1 to 4 carbon atoms.

3. The process of claim 1 or 2, wherein said at least one compound represented by the general formula (I) is a compound represented by the following general formula (Ia);

$$R^1NHNHCOR^{12} \quad (Ia)$$

wherein $R^1$ represents an aryl group and $R^{12}$ represents a hydrogen atom, a methyl group, an unsubstituted phenyl group or a phenyl group substituted with an electron-attracting group.

4. The process of claim 1 or 2, wherein said at least one compound represented by the general formula (I) is a compound represented by the following general formula (Ib);

$$R^{11}NHNHCHO \quad (Ib)$$

wherein $R^{11}$ represents an unsubstituted phenyl group, a p-tolyl group or a m-tolyl group.

5. The process of claim 2, wherein $R^3$ in the general formula (II) represents a hydrogen atom or a nitro group, and $R^4$ and $R^5$ each represents a hydrogen atom, a methyl group or an ethyl group.

6. The process of claim 1 or 2, wherein said at least one polyalkylene oxide or derivative thereof is a compound selected from the group consisting of the following compounds:

$HO\text{-}(CH_2CH_2O)_{90}H$
$C_4H_9O\text{-}(CH_2CH_2O)_{15}H$
$C_{12}H_{25}O\text{-}(CH_2CH_2O)_{15}H$
$C_{18}H_{37}O\text{-}(CH_2CH_2O)_{15}H$
$C_{18}H_{37}O\text{-}(CH_2CH_2O)_{40}H$ $C_8H_{17}CH{=}CHC_8H_{16}O{-}(CH_2CH_2O)_{15}H$

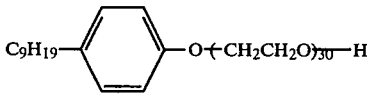

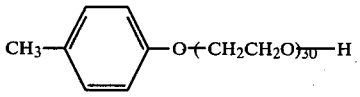

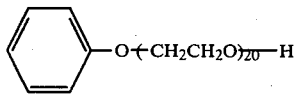

$C_{11}H_{23}COO{-}(CH_2CH_2O)_{80}{-}H$ $C_{11}H_{23}COO{-}(CH_2CH_2O)_{24}{-}C(=O)C_{11}H_{23}$ $C_8H_7CH(COO{-}(CH_2CH_2O)_9{-}H)(COO{-}(CH_2CH_2O)_9{-}H)$ $C_{11}H_{23}CONH{-}(CH_2CH_2O)_{15}{-}H$ $C_{12}H_{25}N((CH_2CH_2O)_{15}{-}H)((CH_2CH_2O)_{15}{-}H)$ $C_{14}H_{29}N(CH_3)(CH_2CH_2O)_{24}{-}H$ $H{-}(OCH_2CH_2)_{14}{-}O{-}CH(CH_2{-}O{-}CH_2{-}CH_2{-}OC_{11}H_{23}){-}CH(O{-}(CH_2CH_2O)_{14}{-}H){-}CH_2{-}(CH_2CH_2O)_{14}{-}H$ $H{-}(CH_2CH_2O)_a{-}(CH(CH_3)CH_2O)_b{-}(CH_2CH_2O)_c{-}H$ where a+b+c is 50 and the ratio of b:a+c is 10:9

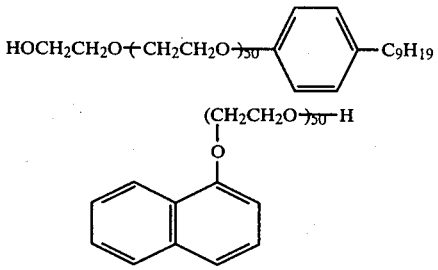

$HO{-}(CH_2CH_2O)_a(CH_2CH_2CH_2CH_2O)_b(CH_2CH_2O)_c{-}H$ where a+c is 30 and b is 14

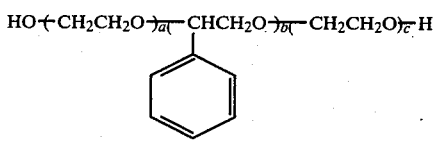

where b is 8 and a+c is 50

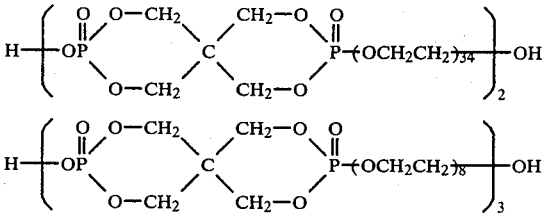

$HO{-}(CH_2CH_2O)_{34}{-}H$ and

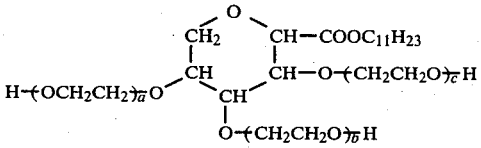

where a+b+c is 30.

7. The process of claim 1 or 2, wherein said silver halide photographic light-sensitive material contains silver halide grains of an average grain size of less than 0.7$\mu$.

8. The process of claim 1 or 2, wherein said dihydroxybenzene is hydroquinone.

9. The process of claim 1 or 2, wherein said developer contains at least 0.25 mol/l of free sulfite ion.

10. The process of claim 2, wherein said at least one compound represented by the general formula (I) is present in said silver halide photographic light-sensitive material and said at least one compound represented by the general formula (II) is present in said developer.

11. The process of claim 1 or 2, wherein the developing is in the presence of a benzotriazole compound as an antifogging agent.

12. The process of claim 11, wherein said benzotriazole compound is 5-methylbenzotriazole.

* * * * *